United States Patent [19]

Harman

[11] Patent Number: 4,994,789

[45] Date of Patent: Feb. 19, 1991

[54] PHASE SHIFT DIVIDED LEAKY CABLE SENSOR

[75] Inventor: R. Keith Harman, Kanata, Canada

[73] Assignee: Senstar Corporation, Ontario, Canada

[21] Appl. No.: 401,820

[22] Filed: Sep. 1, 1989

[30] Foreign Application Priority Data

Sep. 27, 1988 [CA] Canada ..... 578563

[51] Int. Cl.[5] ..... G08B 13/18

[52] U.S. Cl. ..... 340/552; 340/554; 367/93; 367/94

[58] Field of Search ..... 340/554, 552; 367/94, 367/93

[56] References Cited

U.S. PATENT DOCUMENTS

| | | | |
|---|---|---|---|
| 3,947,834 | 3/1976 | Gershberg et al. | 340/554 |
| 4,091,367 | 5/1978 | Harman | 340/552 |
| 4,213,123 | 7/1980 | Poirier | 340/552 |
| 4,612,536 | 9/1986 | Harman | 340/552 |
| 4,887,069 | 12/1989 | Maki et al. | 340/552 |

*Primary Examiner*—Glen R. Swann, III

*Attorney, Agent, or Firm*—Antonelli, Terry, Stout & Kraus

[57] ABSTRACT

A continuous wave (CW) leaky cable sensor for an intrusion detector uses a pair of elongated parallel cables, one for establishing an RF field and the other for receiving the field. A modulator is connected at an intermediate location of the receiving (or transmitting) cable, subdividing a detection zone into detection regions on each side of the modulator. The modulator selectively modifies a signal received by a portion of the receiving cable connected to its input. By processing the signal at the output of the receiving cable, the detection region for either side of the modulator in which an intrusion has occurred can be determined. The resolution of a CW sensor is thus increased at low cost. Multiple modulators can be used at spaced locations increasing the number of detection regions, and thus the resolution.

19 Claims, 4 Drawing Sheets

PHASE SHIFT DIVIDED LEAKY CABLE SENSOR

BACKGROUND OF THE INVENTION

This invention relates to intrusion detector apparatus, and particularly to a sensor for use in such a system.

DESCRIPTION OF THE PRIOR ART

Leaky (ported) coaxial cables have been utilized as distributed antennae for guided radar sensors. In such sensors one coaxial cable is used as a transmitter and the other is used as a receiver. Such cables are typically deployed parallel to each other, usually in an underground location. By applying an RF signal of e.g. 40 MHz to one cable an RF field is set up around the cable which extends into the air, and intersects the other cable. An intruder into the field causes a phase shift in the signal received by the receiving cable, which can be detected at a receiver.

There are basically two distinct types of systems. In one type an RF pulse is transmitted over the transmitting cable, and the time delay to receipt of a signal change induced by the intruding target is determined, to locate the position of the target along the cable. In the other type of system, a continuous wave (CW) signal is transmitted. The receiver in this case can only determine whether a target is present somewhere along the cable length, but cannot determine its location. A description of these types of systems may be found in a paper entitled "A Perimeter Security System" appearing in the proceedings of the 1983 Carnahan Conference on Crime Countermeasures and Security, by R. Keith Harman.

The CW type system is clearly much simpler in that it does not require sophisticated circuitry and high speed signal processing to measure the time delay, as is required by a pulsed type system to locate the target. Further, the pulsed type system utilizes a much broader RF bandwidth (e.g. 5 MHz as compared with 200 Hz in the CW type system), which introduces considerable radio frequency interference and radio licensing concerns. On the other hand for use as an intrusion detector around a long perimeter, multiple CW sensors are required to determine within predefined zones where an intrusion has occurred. The predefined zones are determined by the specific cable lengths attached to each of the CW sensors. For a long detection zone, therefore, the CW sensor system exhibits increasing cost with increasing length.

SUMMARY OF THE INVENTION

The present invention relates to a CW type leaky cable sensor and system which facilitates the location of an intruder target within one of subdivided regions of a detection zone, or allows a detection zone of such a system to be increased, while maintaining the detection region resolution of present systems. Indeed, the present invention can be utilized to subdivide a detection zone into detection regions which are unequal in length. The invention is not limited for use with graded or ungraded leaky coaxial cables, but can be used with all sorts of RF field guiding sensor conductors whether buried or not.

In accordance with important aspects of the present invention a modulator is connected in series with either the cable which causes establishment of the RF field or in series with the cable receiving the RF field, at an intermediate location subdividing a detection zone into detection regions. By placing the modulator in the transmit cable the transmitted bandwidth increases due to the modulation. By placing the modulator in the receive cable the transmitted bandwidth is not affected. For that reason it is preferred that the modulator should be located at an intermediate position in series with the receive cable. Response signals from targets appearing before the modulator (with respect to signal transmission direction within the receive cable) are not affected while those appearing after the modulator are affected by the modulation. Thus by detecting modulation of the received signal, one can discern if the target appeared in the detection region before or after the modulator.

Almost any form of modulation can be utilized. It is preferred, due to simplicity, to utilize phase modulation. Preferably the modulator introduces a periodic 180° phase shift in the received signal. By signal processing, targets approaching the cable sensor before the modulator can be differentiated from targets approaching the cable sensor following the modulator.

It is desired in this case to use a synchronous detector in order to preserve phase response. Targets approaching the cable sensor in the region before the modulator will have a relatively constant phase response, assuming that the target is moving relatively slowly in terms of modulating frequency. On the other hand targets approaching the cable sensor in the region beyond the modulator will exhibit the periodic 180° phase shift introduced by the modulator. If the sampling rate is equal to the modulation rate then simply subtracting every other sample will cause targets after the phase modulator to appear, while adding every other sample will cause targets before the phase modulator to appear.

However other forms of modulation such as amplitude modulation can be used, with appropriate target response separation of signals prior to or following the modulator. It should also be noted that more than one modulator can be used in the receive (or transmit) cable line to provide more detection regions. Each modulator would modulate the signal to a different degree. For example where two phase shift modulators are used, each can shift the phase by 120°, and the various target signals not phase shifted or phase shifted to various degrees can be determined by signal recovery techniques. There is clearly always one more detection zone than there are modulators.

A system of the type described herein provides the necessary detection of a target to within a detection region subdivision of a detection zone of a CW leaky cable sensor type system, while enjoying the simplicity of CW leaky cable sensors. This provides a very distinct advantage over pulsed type sensors and single zone CW type sensors. Using a single modulator for each cable set effectively reduces the number of distributed processors required by a factor of 2 with only a very slight increase in the signal processor complexity.

The invention can be used with all types of CW type sensors, and is not affected by the cable separation. While in most applications the transmit and receive cables have been separated from 0.5 to 2.0 meters, with some recent advances the separation of the cables may be reduced to almost zero and utilize sensor cables as described in U.S. patent application Ser. No. 130,192, filed Dec. lst, 1987, invented by R. Keith Harman and Kenneth I. Smith.

The invention can be utilized by both forward and backward leaky cable sensor systems. In a forward coupled sensor system the receiver is at the opposite end of the cable pair from the transmitter. In a backward coupled sensor system the receiver is at the same end of the cable pair as the transmitter. Backward coupled sensor systems which utilize cable sensitivity grading can also use the present invention.

In accordance with the preferred embodiment of the invention, a continuous wave (CW) sensor for an intrusion detector is comprised of a first means for causing propagation of a CW RF field in an elongated detection zone and a second means in the detection zone for receiving the field. Means connected to the propagation means is provided for distinguishing moving field disturbances from different elongated regions of the zone.

The propagation causing and field receiving means are preferably elongated cables, and can be leaky coaxial cables, while the means for distinguishing moving field disturbances is preferably a modulator connected at an intermediate location in series with the receiving cable within the detection zone to subdivide it into detection regions.

In one embodiment, the modulator is a phase shifter, and in such an embodiment in which there are only two detection regions, the modulator is a 180° phase shifter.

BRIEF DESCRIPTION OF THE DRAWING

A better understanding of the invention will be obtained by reference to the detailed description below in conjunction with the following drawings, in which.

DESCRIPTION OF THE PREFERRED EMBODIMENT

Figure 1:
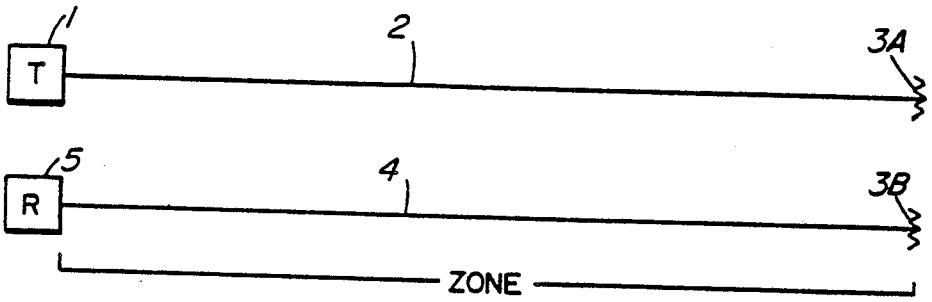
PRIOR ART FIG. 1
FIG. 1 depicts a typical prior art backward coupled leaky cable sensor.

Turning to FIG. 1, a continuous wave backward coupled leaky cable system is shown in accordance with the prior art. A transmitter 1 applies a continuous wave signal to a leaky coaxial cable 2 which is terminated at its far end by a matching impedance 3A. A field is established around the cable 2.

Spaced parallel to cable 2 is a leaky coaxial receiving cable 4 terminated by a matching impedance 3B and which is connected to a receiver 5 located at the same end as receiver 1. Both cables are physically disposed parallel to each other between about 0.5 meters and 2 meters apart with the RF field emitted from the cable 2 extending well above ground level and also intersecting cable 4. Upon intrusion of a body into the field, a phase shift occurs in the received signal. Detection of the occurrence of this phase shift in the receiver indicates the presence of the intruder.

It should be noted that one can only detect the fact that an intruder has moved within the zone constituted by the entire length of the cable, as shown in FIG. 1. As noted earlier, one can provide successive lengths of cable pairs (sensors), but each zone requires its own transmitter and receiver. This clearly becomes expensive for long stretches having multiple zones.

Figure 2:
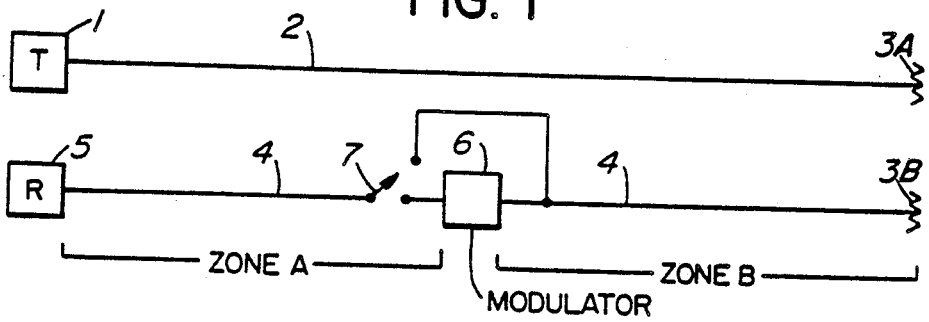
FIG. 2 illustrates such a system using the present invention.

According to the present invention the cable can be subdivided into several zones or regions, shown in FIG. 2 as zone A and zone B, allowing determination of which zone or region has experienced an intrusion, thus increasing the resolution of such a system. The invention requires the use of a modulator 6 which is connected in series with one of the cables where the zone is to be subdivided into shorter serial regions. As noted earlier, the modulator can be connected in series with either the cable connected to the transmitter or to the cable connected to the receiver. However it is preferred that the modulator should be connected in series with the cable connected to the receiver at an intermediate location where the cable is to be subdivided into regions. It should also be noted that several spaced modulators can be used, subdividing the zone into several regions. In general there will be one more region than the count of modulators. For ease of illustration, however, the present description will be restricted to the use of a single modulator subdividing cable 4 to form two regions labelled zone A and zone B in FIG. 2. Modulator 6 is bypassed by a switch 7. Upon detection of an intrusion signal it is assumed that the intrusion is either in zone A or zone B.

With switch 7 switched to modulator 6, if the intrusion is in zone A, the intrusion signal will remain the same as if switch 7 were switched to bypass modulator 6. However if the intrusion is in zone B, the intrusion signal will have been modulated by modulator 6. With the switch 7 switched to bypass modulator 6, there will be no difference in the intrusion signal whether the intrusion is in zone A or zone B. Thus in order to determine the location of the intrusion, where for example modulator 6 introduces a 180° phase shift as its modulation function, one need only subtract the intrusion signal received with switch 7 connected to the modulator from the intrusion signal received with switch 7 connected to bypass the modulator. If the result is zero, the intrusion has occurred in zone A. If the intrusion signal increases, the intrusion has occurred in zone B.

It will be recognized that any kind of modulator can be used. For example if two modulators are used to form three zones, each can shift the signal input to it from the cable by 120°. Amplitude or other modulation techniques can also be used. Suffice to say that it is merely required to electronically separate the effects caused by the modulators on the intrusion signal to determine in which zone the intrusion has occurred.

In the present instance in which the modulator is a 180° phase shift circuit, the modulator can be made physically very small, such as 2 centimeters in diameter and 10 centimeters long, and inserted into the receive cable using connectors at the place where the zones interface. The modulator and connectors should be sealed with shrink tubing to make a water tight "in line" component which can be buried with the cable. At the end of the transmit and receive cable matching impedances 3A and 3B respectively are connected, which also can be covered with shrink tubing to provide an in-line water tight component which can be buried.

It should also be noted that while the cables 2 and 4 typically run parallel to each other using uniform spacing, the spacing in each of the zones can be different. This can include spacing ranging from the typical 0.5 to 2 meters, to very close spacing as described in the aforenoted U.S. patent application.

Figure 3:
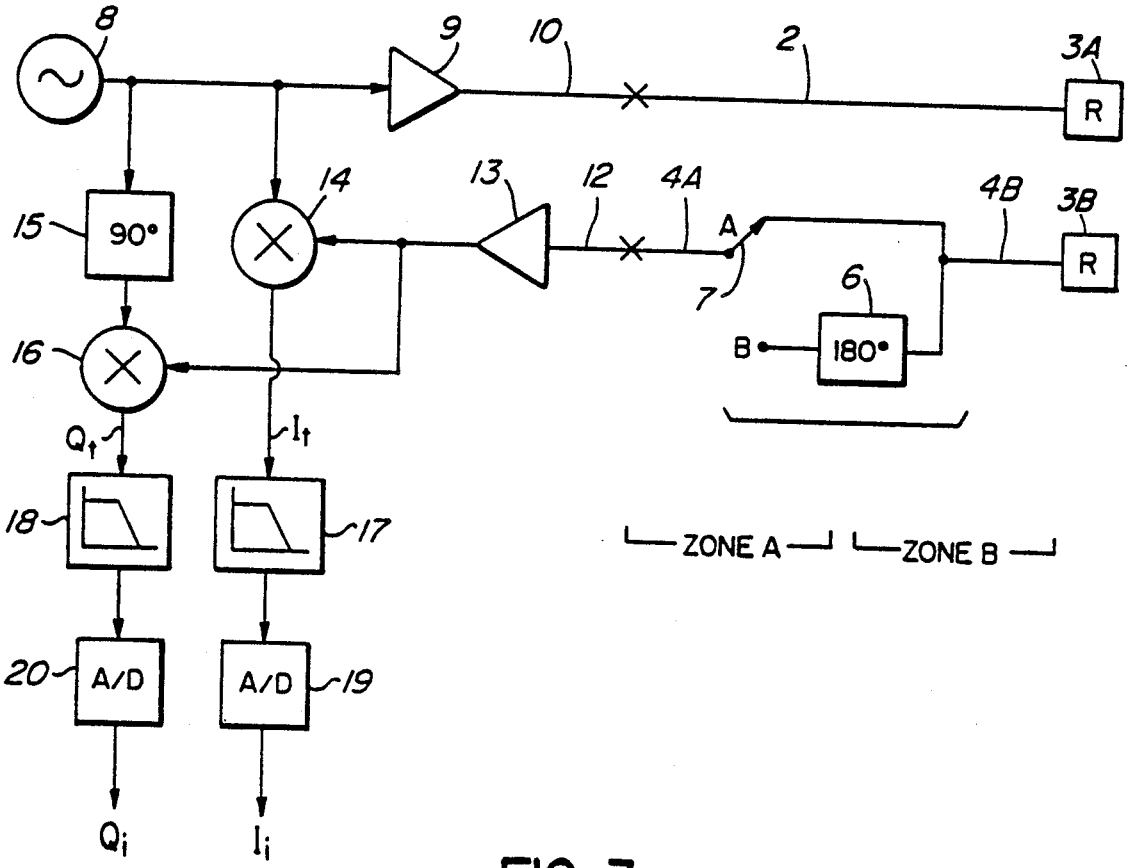
FIG. 3 illustrates in block diagram a continuous wave backward coupled key cable system employing 180° phase shift modulation.

FIG. 3 is a block diagram of the invention including the signal determination structure. An oscillator 8 generates a continuous wave (CW) signal, typically approximately 40 MHZ, and applies it to an amplifier 9. The amplifier applies the resulting signal, typically through a coaxial cable 10 to a leaky coaxial cable 2, which is terminated by a matching impedance 3A as described earlier. Typically the power delivered from amplifier 9 to cable 2 is about 150 milliwatts. While in this example a continuous sinusoidal wave form is used, it can alternatively be a switched continuous wave where the duty cycle may be as low as 10%. Of course more peak power is required for low duty cycle cable sensors so as to produce a sufficient electromagnetic field to detect human intruders. In this specification it is intended that a continuous wave (CW) signal includes a switched continuous wave signal.

A receive leaky coaxial cable, separated into two cable portions 4A and 4B are connected together through switch 7. The signal coupled into the cables 4A and 4B from the field established around cable 2 passes through a length of coaxial cable 12 into amplifier 13. The output signal from amplifier 13 is applied to a mixer 14 to which the transmit signal from oscillator 8, referred to below as an in-phase reference signal, is also applied. Mixing the received signal with the in-phase reference signal in mixer 14 produces the in-phase component from the received signal which is normally referred to as $I_t$.

The in-phase reference signal from oscillator 8 is also phase shifted by 90° in a phase shifter 15, and the resulting signal is applied to mixer 16. Also applied to mixer 16 is the received signal which is output from amplifier 13. The output signal of mixer 16 is referred to as the quadrature component of the received signal, referred to as $Q_t$. The in-phase and quadrature components of the received signal are passed through low pass filters 17 and 18 respectively to eliminate all high frequency components. Filters 17 and 18 should have corner frequencies of about 200 Hz. The output signals of filters 17 and 18 are passed to analog-to-digital converters 19 and 20 respectively to produce sequences of samples $I_i$ and $Q_i$ with new samples taken every $T_i$ seconds. $T_i$ is preferred to be about 27 milliseconds.

It should be noted that only one mixer, one low pass filter and one digitizer need be used which can be time shared to produce the $I_i$ and $Q_i$ sample sequences.

Figure 4:
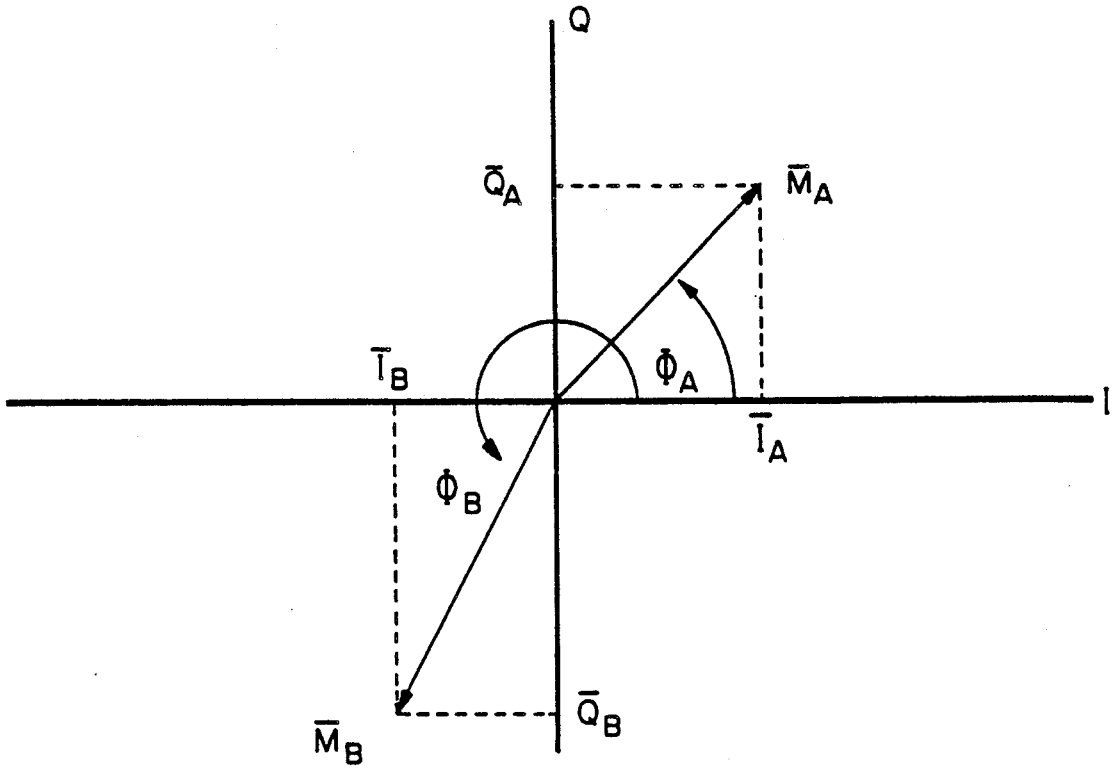
FIG. 4 is a graph illustrating typical fixed return signal vectors plotted on the in-phase and quadrature axes.

FIG. 4 is a phase diagram of the in-phase and quadrature phase received signals $I_t$ and $Q_t$. The quadrature component is plotted on the vertical axis and the in-phase component on the horizontal axis. The magnitude M of the received signal is found from the square root from the sum of the squares of the I and Q components. The phase angle, $\phi$ of the received signal is the arctangent of Q divided by I. In the absence of an intruder and with the receive cables 4A and 4B connected directly in series through switch 7 (FIG. 3), a relatively stable response $M_A$ is obtained, while with switch 7 in position B, which places modulator 6 in series with cables 4A and 4B, a relatively stable response $M_B$ is obtained. These relatively fixed responses can be referred to as "clutter values".

When an intruder crosses into the field received by cables 4A or 4B, both $M_A$ and $M_B$ are perturbed. These perturbations are processed digitally to detect the intruder and to determine if the response is in zone A or zone B.

Figure 5:
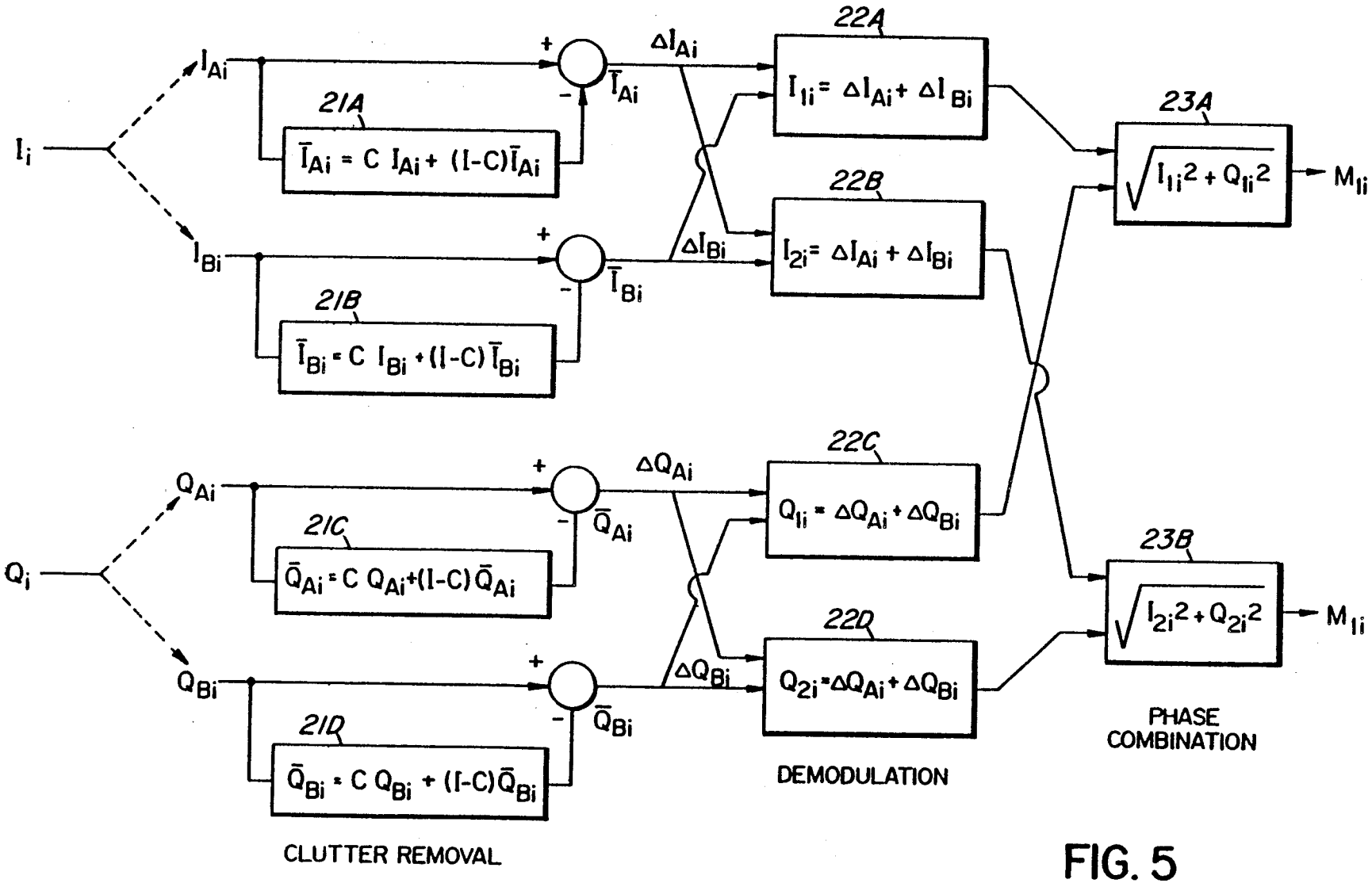
FIG. 5 is a signal flow diagram showing signal processing associated with 180° phase shift modulation.

FIG. 5 presents a flow chart for operation of a digital signal processor required to detect an intruder and to determine in which zone the intrusion has occurred. The phase modulator 6 introduces its 180° phase shift for every second sample for in-phase and quadrature component. In FIG. 5, the samples taken with switch 7 in position A are denoted by $I_{Ai}$ and $Q_{Ai}$ while those with the switch in position B are denoted by $I_{Bi}$ and $Q_{Bi}$.

In the signal flow diagram the samples with the switch in position A and with the switch in position B are processed separately. The first step in the signal processing algorithm is to remove the fixed clutter by means of single or multiple pole recursive high pass filters 21A–21D. The time constants of these filters are determined by the constant C in the filter equations illustrated in FIG. 5 within the block 21A–21D which denote the filters. Typically the constant C is selected to produce a time constant of 25 seconds which produces a lower corner frequency of approximately 4 millihertz. The output signals of the four high pass filters are $\Delta I_{Ai}$, $\Delta Q_{Ai}$, $\Delta I_{Bi}$ and $\Delta Q_{Bi}$, which are shown on the diagram of FIG. 5. These sequences of samples contain all of the intruder response information, but an intruder in either zone A or zone B causes a response in both the streams of data in which the switch is in the position A or B (referred to below as the A and B streams of data).

The next step in the algorithm is to demodulate the response data by taking sums and differences of the A and B streams of data. The sums and differences are effected in signal processing blocks 22A–22D. The sum of the A and B streams of data give rise to the response corresponding to zone A which are defined as the $I_{1i}$ and $Q_{1i}$ sample sequences. The difference of the A and B streams of data give rise to the response corresponding to zone B which are defined as $I_{2i}$ and $Q_{2i}$ sample sequences. The addition and subtraction are shown as the equations in the signal processor blocks 22A–22D in FIG. 5.

As a result of this demodulation, an intruder in zone A appears only in the $I_{1i}$, $Q_{1i}$ sample sequences, while an intruder in Zone B appears only in the $I_{2i}$, $Q_{2i}$ sample sequences. The result is as if there were two separate cable pairs for zone A and zone B.

The next step in the signal processing algorithm is to take the square root of the sum of the squares of the in-phase and quadrature response signals. This occurs in signal processing blocks 23A, the signal processing function of which is illustrated as the equations in blocks 23A and 23B. The result is the target response magnitudes $M_{1i}$ and $M_{2i}$ for zones A and B respectively.

The final stage in the signal processing algorithm is not illustrated in FIG. 5. The magnitude of the signals $M_{1i}$ and $M_{2i}$ are compared in comparators to predefined thresholds to determine if an intruder is present in either zone A or zone B.

In practice the square root of the sum of the squares function is often approximated by the function:

$$M_{Qi}=max[|\Delta I_i|,|\Delta Q_i|]+\tfrac{3}{8}min[|\Delta I_i|,|\Delta Q_i|]$$

This signal processing function is easier to compute and is a very good approximation to the ideal square root of the sum of the squares function and is thus preferred. One can also high pass filter the signal magnitude sequences $M_{1i}$ and $M_{2i}$ to further reduce the response from very slow moving environmental changes.

Figure 6:
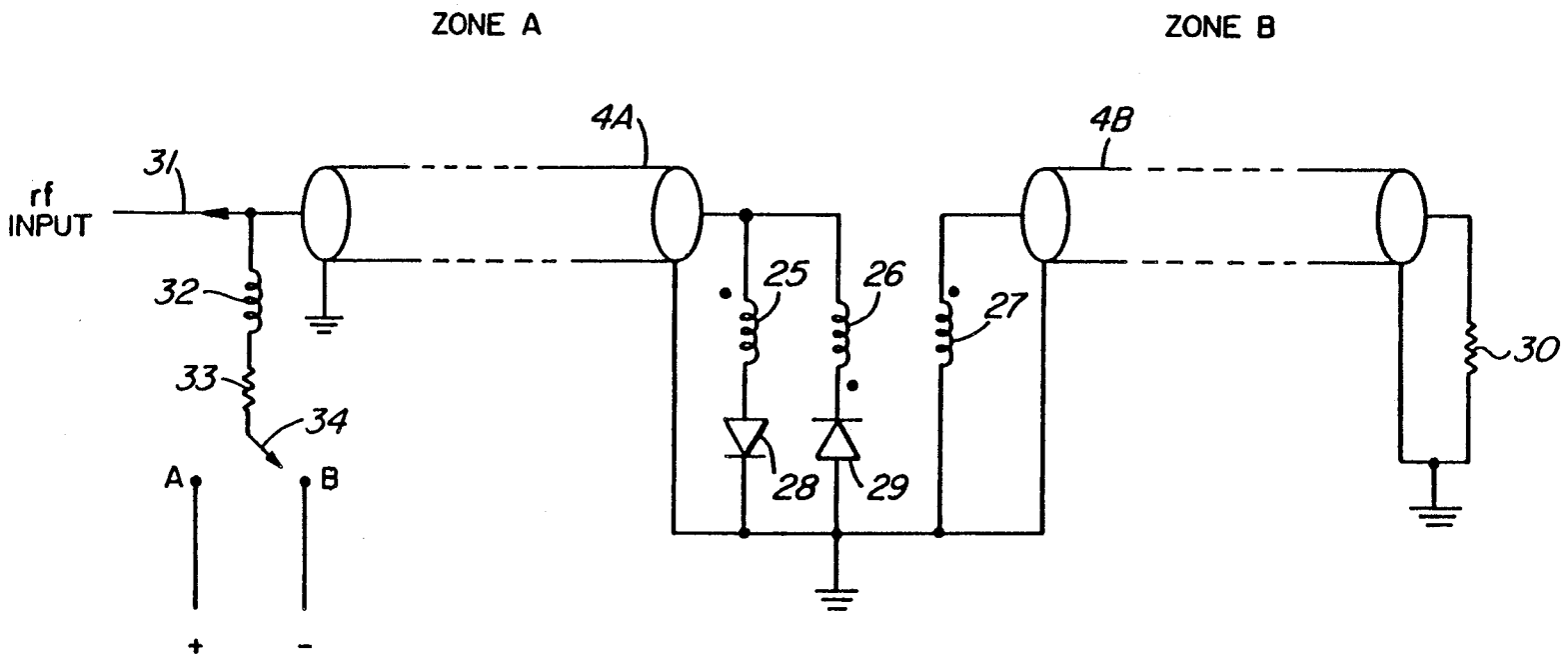
FIG. 6 is a schematic diagram of a 180° phase shift circuit and its activation circuit in accordance with a preferred form of the invention.

FIG. 6 illustrates a circuit for providing a 180° phase modulator which is used in the preferred embodiment.

The modulator is comprised of three identical windings 25, 26 and 27 on a toroidal transformer core along with two switching diodes 28 and 29 in series with windings 25 and 26 respectively. As may be seen by the positions of the dots in the conventional dot diagram, windings 25 and 27 are wound in the mutually aiding direction while winding 26 is wound in the opposing direction. Diodes 28 and 29 are connected with the polarity shown in series with the windings 25 and 26, the cathode of diode 28 being connected to the anode of diode 29, to the undotted end of winding 27, to the shields of leaky cable portions 4A and 4B, and to ground. The opposite end of cable 4B is connected to a matching impedance (approximated by resistor 30), the shield also being connected to ground. The opposite end of cable 4A has its shield connected to ground, its center conductor connected to provide the CW radio frequency receive signal, at lead 31. Lead 31 is connected through an isolating inductor 32 and series connected limiting resistor 33 to a source of low frequency square waves illustrated schematically by electronic switch 34 repetitively switching between a − and + current source.

In operation, electronic switch 34 applies a low frequency square wave through resistor 33 and inductor 32 to lead 31, superimposing it upon the receive coaxial cable signal to drive the phase modulator. The radio frequency signals are isolated from the received signal carried by lead 31 by inductor 32, while resistor 33 limits the current being sent to the phase modulator over cable 4A. With the square wave generating switch in position A, diode 28 is forward biased by the current source, thereby forming a low impedance for a very low voltage radio frequency received signal passing through the transformer formed by the coils from zone B, i.e. from cable 4B. At the same time diode 29 is reverse biased forming a high impedance to the low voltage radio frequency received signal. Because the transformer windings 27 and 25 are wound in the mutually aiding direction, the signal is passed through the transformer in phase.

It should be noted that diodes 28 and 29 should be types that have a low forward conduction threshold voltage.

When switch 34 moves to position B, diode 29 becomes forward biased while diode 28 becomes reverse biased. This causes the winding 26 to be activated and to conduct, in place of winding 25, to introduce a 180° phase shift in the signal received from cable 4B.

As indicated earlier, the modulator could equally well be placed in the transmit cable. However this would transmit a broader bandwidth, which is believed to be much less desirable.

It should be noted that while the preferred embodiment uses 180° phase modulation, other types of modulation could be utilized. A different modulation scheme would of course require a different demodulation signal processing algorithm. However now that the present invention has been described, such other modulation schemes and demodulation schemes would become evident to persons skilled in the art.

A person understanding this invention may now conceive of other embodiments or variations thereof using the principles described herein. All are considered to be within the sphere and scope of this invention as defined in the claims appended hereto.

I claim:

1. A continuous wave (CW) sensor for an intrusion detector comprising first cable means for causing propagation of a CW RF field in a detection zone, second cable means for receiving the field in the detection zone, and means connected at an intermediate location in series with one of the first and second cable means, for selectively modifying a signal received by the second cable means, whereby the detection zone is divided into separate regions on opposite sides of the modifying means.

2. A continuous wave (CW) sensor for an intrusion detector system comprising first cable means for causing propagation of a CW RF field in a detection zone, second cable means for receiving the field in the detection zone, and means connected at an intermediate location in series with the second cable means, for selectively modifying a signal received by a portion of the second cable, whereby the detection zone is divided into separate regions on opposite sides of the modifying means.

3. A sensor as defined in claim 2 in which the modifying means is a modulator.

4. A sensor as defined in claim 3 in which the second cable means is parallel to the first cable means in each of the separate regions.

5. A sensor as defined in claim 2 in which the means for selectively modifying is comprised of a modulator and means for periodically switching the modulator in series with the second cable and means for periodically bypassing the modulator during the periods that the modulator is not in series with the second cable.

6. A sensor as defined in claim 3, 4 or 5 in which the modulator is a phase shifter.

7. A sensor as defined in claim 3, 4 or 5 in which the modulator is a 180° phase shifter.

8. For use in an intrusion detection system, a sensor as defined in claim 3, 4 or 5 in which the modulator is a phase shifter for periodically shifting the phase of a received signal which is applied thereto from a region of the second cable, the system further comprising receiving means connected to the end of the second cable means in the other region for sampling, synchronously with said periods, signals received by the second cable means, subtracting corresponding phase shifted samples and subtracting corresponding unshifted samples in each sampling cycle to produce signals corresponding to the intrusion status of said regions on opposite sides of said modulator.

9. For use in an intrusion detection system, a sensor as defined in claim 3 in which the modulator is a 180° phase shifter for introducing a periodic 180° phase shift in a signal applied thereto received by the second cable means, the system further including receiving means connected to a remote end of the second cable which is connected to the output of the phase shifter for synchronously sampling the received signal in each phase shifted and unshifted period, and for subtracting every second sample to obtain an indication of intrusion targets in the detection zone between the phase shifter and one end of the second cable, and for synchronously adding every other second sample to obtain an indication of intrusion targets in the detection zone between the phase shifter and the other end of the second cable.

10. A sensor as defined in claim 2, 5 or 9 in which the cable means are leaky coaxial cables.

11. A sensor as defined in claim 2, 5 or 9 in which the cable means are graded leaky coaxial cables.

12. A sensor as defined in claim 3, in which the modulator is a 180° phase shifter for introducing a periodic 180° phase shift in a signal which is applied thereto received by the second cable means, the system further including a first mixer for receiving a sample of a transmit signal applied to the first cable means and a sample of a receive signal from the second cable means, a 90° phase shifter for 90° phase shifting a sample of the transmit signal, a second mixer for receiving the 90° phase shifted sample of the transmit signal and a sample of the receive signal, first and second low pass filters for receiving output signals of the first and second mixers, and means for synchronously comparing the output of the low pass filters with the periodically 180° phase shifted receive signal to obtain separate indications within the alternate 180° and non-phase shifted periods of the receive signal of the intrusion status of each of the separate regions of the detection zone.

13. A sensor as defined in claim 3, 5 or 9 in which the modulator is comprised of a three winding transformer having a primary winding connected across one portion of the second cable means at said intermediate location and first and second secondary windings each connected across the other portion of the second cable means at said intermediate location, the primary and first secondary windings being wound in a mutually aiding direction, and the second secondary winding being wound in opposing direction relative to the primary winding, and means for periodically interrupting circuits alternately through each of the secondary windings, whereby signals being transferred from said one portion of the second cable means to said other portion are periodically shifted in phase by 180°.

14. A sensor as defined in claim 3, 5 or 9 in which the modulator is comprised of a three winding transformer having a primary winding connected across one portion of the second cable means at said intermediate location and first and second secondary windings each connected across the other portion of the second cable means at said intermediate location, the primary and first secondary winding being wound in a mutually aiding direction, and the second secondary winding being wound in opposing direction relative to the primary winding, and electronic switch means for alternately periodically interrupting circuits through each of the secondary windings, whereby signals being transferred from said one portion of the second cable means to said other portion are periodically shifted in phase by 180°.

15. A sensor as defined in claim 3, 5 or 9 in which the modulator is comprised of a three winding transformer having a primary winding connected across one portion of the second cable means at said intermediate location and first and second secondary windings each connected across the other portion of the second cable means at said intermediate location, the primary and first secondary winding being wound in a mutually aiding direction, and the second secondary winding being wound in opposing direction relative to the primary winding, a pair of oppositely poled diodes connected in series with the first and second secondary windings respectively, and means for alternatingly applying positively and negatively poled current to the diodes for respectively forward and reverse biasing them periodically, thereby alternatingly and periodically interrupting currents through each of the secondary windings, whereby signals being transferred from said one portion of the second cable means to said other portions are periodically phase by 180°.

16. A sensor as defined in claim 3, 5 or 9 in which the modulator is comprised of a three winding transformer having a primary winding connected across one portion of the second cable means at said intermediate location and first and second secondary windings each connected across the other portion of the second cable means at said intermediate location, the primary and first secondary windings being wound in a mutually aiding direction, and the second secondary winding being wound in opposing direction relative to the primary winding, a pair of oppositely poled diodes connected in series with the first and second secondary windings respectively, and means for alternatingly applying positively and negatively poled current to the diodes for respectively forward and reverse biasing them periodically, thereby alternatingly and periodingly interrupting currents through each of the secondary windings, said positively and negatively poled currents being applied through a decoupling inductor at a remote end of said other portion of the second cable means.

17. A continuous wave (CW) sensor for an intrusion detector comprising first means for causing propagation of a CW RF field in an elongated detection zone, and second means in the detection zone for intersecting the field, and means connected to the second means for distinguishing in which, different elongated region of said zone a moving field disturbance occurs.

18. A modulator comprised of a three winding transformer having a primary winding for receiving an input signal, and a first and a second secondary winding, the secondary windings being connected in parallel across an output, the primary and the first secondary windings being wound in a mutually aiding direction, and the second secondary winding being wound in opposing direction relative to the primary winding, and means for alternately periodically interrupting circuits through each of the secondary windings, whereby signals transferred from the input to the output are periodically shifted in phase by 180°.

19. A modulator as defined in claim 18 in which the interrupting means is comprised of a pair of oppositely poled diodes connected in series with the first and second secondary windings respectfully, and means for alternatingly applying positively and negatively poled current to the diodes from the output for respectively forward and reverse biasing said diodes periodically, thereby alternatingly and periodically interrupting circuits through each of the secondary windings.

* * * * *